United States Patent [19]

Jones et al.

[11] Patent Number: 5,049,211

[45] Date of Patent: Sep. 17, 1991

[54] RAPID SOLIDIFICATION ROUTE ALUMINIUM ALLOYS CONTAINING CHROMIUM

[75] Inventors: Howard Jones, Sheffield; Panayiotis Tsakiropoulos, Petersfield, both of England; Charles R. Pratt, Neath, United Kingdom; Robert W. Gardiner, Farnham; James E. Restall, deceased, late of Camberley, both of England, by Janet E. Restall, Executrix

[73] Assignee: The Secretary of State for Defence in Her Britannic Majesty's Government of the United Kingdom and Northern Ireland, London, England

[21] Appl. No.: 346,174

[22] PCT Filed: Oct. 10, 1987

[86] PCT No.: PCT/GB87/00735

§ 371 Date: Apr. 13, 1989

§ 102(e) Date: Oct. 13, 1989

[87] PCT Pub. No.: WO88/03179

PCT Pub. Date: May 5, 1988

[30] Foreign Application Priority Data

Oct. 21, 1986 [GB] United Kingdom ..... 8625190

[51] Int. Cl.[5] ..... C22C 21/00

[52] U.S. Cl. ..... 148/437; 420/522

[58] Field of Search ..... 420/528, 552; 148/437

[56] References Cited

U.S. PATENT DOCUMENTS 4,347,076 8/1982 Ray et al. ..... 148/437

*Primary Examiner*—R. Dean

*Attorney, Agent, or Firm*—Nixon & Vanderhye

[57] ABSTRACT

An alloy formed by rapid solidification comprising Al, 1 to 7 wt % Cr and up to 6 wt % X where X is selected from refractory metals Nb, Mo, Hf, Ta, and W, has improved thermal stability.

3 Claims, No Drawings

RAPID SOLIDIFICATION ROUTE ALUMINIUM ALLOYS CONTAINING CHROMIUM

This invention relates to aluminium based alloys containing chromium, made by the rapid solidification rate (RSR) route.

Conventional high strength wrought ingot aluminium alloys have limited thermal stability at temperatures above about 150° C. because of coarsening of the precipitates on which their high strength depends. This precipitate coarsening stems from a combination of high diffusivity and appreciable equilibrium solid solubility in aluminium of the alloying elements usually employed (such has zinc, copper, magnesium, silicon and latterly lithium) and significant interfacial energy of the precipitate/matrix interface at these relatively elevated temperatures.

The desirability of adopting other alloying elements to confer improved high temperature stability for high strength wrought ingot aluminium alloys is frustrated by the limited maximum equilibrium solid solubility of elements other than those mentioned above. Such limited solid solubility leads to the formation of coarse embrittling intermetallic compounds on solidification via the conventional ingot route.

It would be desirable to have a high strength aluminium alloy with better high temperature stability than that afforded by known ingot route materials. The RSR route offers a way of enlarging the field of alloying elements for it offers a way of circumventing equilibrium solid solubility limitations and enables a way of producing aluminium based alloys with a higher volume fraction and better dispersion of suitable elements or intermetallic compounds. A fine dispersion of such intermetallics which is also evenly distributed avoids the undesirable embrittlement experienced when these alloying elements become segregated in production of materials via the ingot route. Moreover the intermetallics formed by suitable elements can possess a high resistance to coarsening (leading to enhanced thermal stability) because they have a high melting point coupled with a low diffusivity and solubility in solid aluminium at the temperatures in question.

Various RSR routes are well established. They possess in common the imposition of a high cooling rate on an alloy from the liquid or vapour phase, usually from the liquid phase. RSR methods such as melting spraying, chill methods and weld methods are described in some depth in Rapid Solidification of Metals and Alloys by H. Jones (published as Monograph No 8 by The Institution of Metallurgists) and in many other texts. The various RSR methods differ from one another in their abilities in regard to control of cooling rate. The degree of dispersed refinement and the extension of solid solubility are dependent on the rate of cooling from the melt.

Previous workers have sought to use RSR methods to produce aluminium alloys having good strength coupled with improved thermal stability. Binary alloys which have been investigated include aluminium-iron, aluminium-chromium, aluminium-manganese and aluminium-zirconium. U.S. Pat. No. 4,347,076 claims a vast range of compositions within the scope of aluminium with 5/16 weight percent of one or more of iron chromium nickel cobalt manganese vanadium titanium zirconium molybdenum tungsten and boron; although few of these combinations are examplified other than aluminium-iron bases ones.

Two drawbacks of basing developments on systems of the widely explored aluminium-iron type are that conditions of rapid solidification required to generate segregation-free and/or extended solid solutions approach the limits of standard rapid solidification processing and that fine-scale decomposition within these solid solutions puts them into their hardest condition making consolidation exceptionally difficult.

The need to aid processability by relaxing both of these limitations led to the exploration of the potential of the aluminium-zirconium, aluminium-chromium and aluminium-manganese systems and their combinations as alternative bases for alloy development. All three systems start to exhibit extension of solid solubility even under chill-casting conditions of rapid solidification and their extended solid solutions are much more resistant to decomposition in the solid state. This allows extended solid solutions to be produced under less stringent conditions of rapid solidification and successful consolidation to be achieved at smaller applied pressures. The full strength of the material can then be developed subsequently by appropriate thermal or thermomechanical treatment, as for a conventional wrought alloy. Required ageing temperatures are significantly higher (e.g. 400° C.) than (e.g. 160° C.) for conventional age hardening alloys based on addition of zirconium, chromium and silicon combined with manganese, attributable to the much lower diffusivities of additions such as chromium and zirconium in the aluminium-lattice. This work has led to an aluminium-chromium-aluminium-manganese alloy patented in GB2146352.

Various attempts have been made in recent years to explore aluminium-chromium—X systems using elements other than zirconium for X. Some compositions which have been recorded are: aluminium—5 weight percent chromium—1 weight percent X where X is silicon, manganese, iron, cobalt, nickel, copper as well as zirconium; and aluminium—3.5 weight percent chromium—1 weight percent X where X is silicon, titanium, vanadium, manganese, nickel as well as zirconium. These experiments have not resulted in any alloy which has reached the market place.

It is an object of this invention to devise an aluminium based alloy produced by an RSR route which has an improved combination of strength and structural stability (in a temperature regime of say 150°-200° C.) having regard to those prior art RSR aluminium alloys which have been the subject of principal commercial interest. The reference prior art alloys against which the merits of the current invention should be judged are the following: Al-5Cr-1.5Zr-1.4Mn; Al-8Fe-4Ce; and Al-8Fe-2Mo (all proportions being by weight percent). The general properties of these alloys are well documented in prior art papers and are not included in this specification. It is a secondary object of this invention to produce such an aluminium based RSR alloy as has a combination of properties suitable for use as a compressor blade material for gas turbine engines, so as to offer an alternative to titanium based materials in current engines.

The invention is an aluminium alloy formed by rapid solidification which alloy consists essentially of the following in proportions by weight percent.

| | |
|---|---|
| chromium | 1 to 7 |

-continued

| | |
|---|---|
| X | up to 6 |
| zirconium | 0 to 4 |
| aluminium | balance (save for incidental impurities); |

wherein X is one or more of the elements from the group of refractory metal elements consisting of niobium, molybdenum, hafnium, tantalum, and tungsten; and wherein either:

a. X is present in an amount in excess of 1 weight percent; or b. X is present in some lesser amount yet the total amount of chromium, X, and zirconium (if present) exceeds 5 weight percent.

All compositions given hereinafter are stated in proportions by weight percent. Alloys of the invention have room temperature tensile strengths comparable with the aforementioned reference compositions but demonstrate improved thermal stability as evaluated by measurements of microhardness (at the splat level) after prolonged exposure to elevated temperature.

Preferably the alloy includes at least 4 percent chromium. If zirconium be present in the alloy it is preferably in the range 0.5–3.5 percent.

In order to prepare the alloys of the invention to compositions having alloying ingredients at the upper end of the range (the more super-saturated alloys) it is necessary to utilise a RSR technique adequate to establish a sufficiently high cooling rate. Splat quenching has been used for laboratory specimens but a technique such as gas atomising or planar flow casting would be preferred for industrial scale work.

Preferred sub-species of the invention are as follows:

(a) aluminium - 1/7 chromium - up to 6 hafnium
(b) aluminium - 4/5 chromium - 2/5 hafnium
(c) aluminium - 1/7 chromium - 1/6 niobium, molybdenum or tungsten - 0.5/3.5 zirconium The alloys of the invention are exemplified by the examples thereof given in the following Tables 1–3. In these Tables alloys of the invention are compared with materials made to the prior art reference compositions mentioned earlier. The materials documented in Table 1 and Table 2 are materials in RSR splat form produced in an argon atmosphere by the twin piston method described at pages 11 and 12 of the aforementioned text by H. Jones. This involves levitation of the specimen, induction heating, liquid fall under gravity and chill cooling between two impacting pistons. The splats were typically 50 mm thick.

TABLE 1

HARDNESS OF AL—CR—X AND REFERENCE ALLOY SPLATS AS A FUNCTION OF THE DURATION OF TREATMENT AT 400° C.

| Composition wt % | | As splatted | 1 h | 10 h | 100 h | 1000 h |
|---|---|---|---|---|---|---|
| Al-4.9Cr-1.3Nb | | 89 ± 3 | 82 ± 20 | 85 ± 4 | 79 ± 8 | 79 ± 4 |
| Al-4.6 Cr-0.7Mo | | 98 ± 10 | 90 ± 8 | 81 ± 9 | 93 ± 7 | 75 ± 8 |
| Al-1Cr-3.2Hf | | 53 ± 7 | 64 ± 3 | 70 ± 4 | 46 ± 3 | 44 ± 3 |
| Al-Cr-6Hf | | 60 ± 6 | 99 ± 11 | 96 ± 6 | 73 ± 8 | 61 ± 5 |
| Al-3Cr-3.2Hf | | 85 ± 7 | 87 ± 10 | 85 ± 6 | 120 ± 7 | 85 ± 7 |
| Al-3.5Cr-1.5Hf | | 92 ± 3 | 86 ± 8 | 94 ± 4 | 93 ± 4 | 68 ± 4 |
| Al-5Cr-2.4Hf | | 99 ± 3 | 97 ± 9 | 105 ± 8 | 109 ± 11 | 94 ± 8 |
| Al-5Cr-5.3Hf | | 107 ± 8 | 161 ± 9 | 152 ± 15 | 132 ± 13 | 106 ± 13 |
| Al-7Cr-1Hf | | 112 ± 6 | 118 ± 5 | 116 ± 4 | 96 ± 5 | 90 ± 2 |
| Al-5Cr-1Ta | | 78 ± 8 | 85 ± 10 | 88 ± 5 | 82 ± 13 | 67 ± 7 |
| Al-4.7Cr-1.4W | | 103 ± 8 | 88 ± 7 | 84 ± 9 | 85 ± 11 | 87 ± 5 |
| Al-5Cr | prior | 89 ± 5 | 89 ± 5 | 77 ± 4 | 68 ± 13 | 60 ± 7 |
| Al-5Cr-1.5Zr | art | 95 ± 13 | 129 ± 11 | 138 ± 12 | 109 ± 10 | 97 ± 6 |
| Al-7.8Fe-3Ce | compo- | 300 ± 18 | 149 ± 13 | 131 ± 10 | 88 ± 7 | 78 ± 5 |
| Al-8.8Fe-1.3Mo | sitions | 192 ± 29 | 159 ± 14 | 135 ± 7 | 110 ± 12 | 92 ± 7 |

Table 1 discloses the retained microhardness of alloys having one refractory metal inclusion and no zirconium. Comparison is made with known compositions.

The microhardness of many of the examples improves upon the basic Al-5Cr system. The peak value of microhardness is the most important as the heat treatment is chosen to produce this maximum.

The composition Al-5Cr-5.3Hf shows the best peak value at 161±9 kg $mm^{-2}$. This is an improvement on all of the comparison alloys having a basic ternary composition except for those having Al-Fe+Mo or Ce. The Al-Fe alloys however have the peak value in the as-splatted form and the microhardness declines from then on making it difficult to machine etc. as all working must be cold.

TABLE 2

HARDNESS OF AL—CR—ZR—X ALLOY SPLATS AS A FUNCTION OF DURATION OF TREATMENT AT 400 ° C.

| Composition wt % | As splatted | 1 h | 10 h | 100 h | 1000 h |
|---|---|---|---|---|---|
| Al-1.5Cr-3Zr-0.8Nb | 83 ± 7 | 133 ± 9 | 129 ± 14 | 113 ± 13 | 91 ± 11 |
| Al-1.5Cr-3Zr-1.7Nb | 82 ± 17 | 128 ± 8 | 122 ± 7 | 113 ± 13 | 86 ± 19 |
| Al-5Cr-1.5Zr-0.8Nb | 101 ± 7 | 132 ± 8 | 115 ± 20 | 128 ± 7 | 93 ± 9 |
| Al-5.3Cr-1.5Zr-1.3Nb | 117 ± 17 | 137 ± 6 | 145 ± 15 | 134 ± 10 | 107 ± 10 |
| Al-4.9Cr-1.6Zr-0.3Mo | 76 ± 12 | 86 ± 10 | 106 ± 18 | 92 ± 4 | 107 ± 17 |
| Al-1.5Cr-3Zr-1.1W | 89 ± 16 | 135 ± 20 | 138 ± 20 | 113 ± 6 | 96 ± 7 |
| Al-1.5Cr-1.7Zr-1.3W | 85 ± 6 | 121 ± 7 | 131 ± 10 | 138 ± 8 | 122 ± 10 |
| Al-4.6Cr-1.7Zr-1.2Mn) | 103 ± 11 | 125 ± 9 | 129 ± 4 | 122 ± 5 | 111 ± 7 |

(Al-4.6Cr-1.7Zr 1.2Mo is a prior art composition)

Table 2 shows quaternary alloys of this invention based on additions of zirconium and chromium compared with a prior art alloy having composition Al-4.6Cr-1.7Zr-1.2Mn by weight percent. Alloys containing niobium or tungsten have the best peak values and the tungsten alloys especially show a substantial improvement over the comparison data.

TABLE 3

TENSILE PROPERTIES AT 20° C. OF EXTRUSIONS OF CANNED AND DEGASSED RAPIDLY-SOLIDIFIED ALLOY POWDERS

| Composition (wt %) | 0.2% proof stress (MPa) | Ultimate strength (MPa) | Elongation to fracture (%) |
|---|---|---|---|
| Al-5Cr-5Hf | 373 | 492 | 6.7 |
| | 380 | 490 | 6.7 |
| Al-5Cr-1.5Zr-1.3Nb | 355 | 445 | 4.9 |
| | 354 | 446 | 3.1 |
| Al-5Cr-1.5Zr-1.2W | 383 | 485 | 4.3 |
| | 404 | 480 | 2.4 |
| Al-5Cr-1.5Zr (prior art composition) | 302 | 407 | 14.1 |
| | 318 | 399 | 14.1 |

The materials documented in Table 3 were produced from RSR powders prepared by a high pressure argon atomisation to a mean particle size of 20 μm. The powders were canned and degassed under vacuum at the extrusion temperature (300 degrees Celcius) for 4 hours. The cans were then sealed and the material extruded to round bar at a 16.1 reduction ratio.

Table 3 shows the tensile properties of some of the alloys having the higher peak microhardness values. It can be seen that these compare very favourably with Al-5Cr-1.5Zr as a reference prior art composition.

Alloys where X=Ta are not specifically noted in the Tables but are expected to give comparably improved results.

It is claimed:

1. An aluminium alloy formed by rapid solidification which alloy consists essentially of the following in proportions by weight percent:

| | |
|---|---|
| chromium | 1 to 7 |
| hafnium | 1 to 6 |
| aluminum | balance, excluding incidental impurities. |

2. The aluminium alloy as claimed in claim 1, which consists essentially of the following proportions by weight percent:

| | |
|---|---|
| chromium | 4 to 5 |
| hafnium | 2 to 6 |
| aluminum | balance, excluding incidental impurities. |

3. The aluminium alloy as claimed in claim 1, having the nominal composition in proportions by weight percent of:

| | |
|---|---|
| chromium | 5 |
| hafnium | 5 |
| aluminum | balance, excluding incidental impurities. |

* * * * *